US005315802A

United States Patent [19]

Hart

[11] Patent Number: 5,315,802

[45] Date of Patent: May 31, 1994

[54] MODULAR WALL SYSTEM

[75] Inventor: Thomas W. Hart, Hickory, N.C.

[73] Assignee: Solite Corporation, Richmond, Va.

[21] Appl. No.: 857,268

[22] Filed: Mar. 25, 1992

[51] Int. Cl.[5] ..... E04B 5/04

[52] U.S. Cl. ..... 52/607; 52/605; 52/608; 52/426; 52/745.1

[58] Field of Search ..... 52/562, 563, 564, 605, 52/606, 607, 426, 596, 608, 609, 610, 611, 585, 745.09, 745.1, 745.17, 745.18

[56] References Cited

U.S. PATENT DOCUMENTS

| | | | |
|---|---|---|---|
| 707,444 | 8/1902 | Moses . | |
| 867,954 | 10/1907 | Davis . | |
| 1,507,831 | 9/1924 | Hatch | 72/1 |
| 1,566,988 | 12/1925 | Simmons et al. | 52/605 |
| 1,794,060 | 2/1931 | Brozek . | |
| 1,962,514 | 6/1934 | MacWilliam | 72/103 |
| 2,114,774 | 4/1938 | Brozek | 72/102 |
| 2,225,612 | 12/1940 | Allen | 52/605 |
| 3,206,373 | 9/1965 | Dupuy | 52/608 |
| 3,557,505 | 1/1971 | Kaul | 52/275 |
| 4,058,944 | 11/1977 | Reiger | 52/235 |
| 4,532,747 | 8/1985 | Koetje | 52/586 |
| 4,567,707 | 2/1986 | Herman | 52/586 |
| 4,633,630 | 1/1987 | Kindylides | 52/204 |
| 4,704,832 | 11/1987 | Vassiladis | 52/279 |
| 4,719,737 | 1/1988 | Swart | 52/605 |
| 4,884,378 | 12/1989 | Scheiwiller | 52/169.4 |
| 5,033,912 | 7/1991 | Vidal | 405/262 |
| 5,066,169 | 11/1991 | Gavin et al. | 405/284 |

*Primary Examiner*—Carl D. Friedman
*Assistant Examiner*—Kien Nguyen
*Attorney, Agent, or Firm*—Dowell & Dowell

[57] ABSTRACT

Construction block units having spaced vertical bores with angularly disposed reduced rear access openings are assembled without mortar and have elongated rearwardly extending anchors with head ends received in the bores, the outer portions of adjacent converging anchors interengaging and supported so that the head ends extend vertically above a row of units for engagement by a second row of units to form a retaining wall. A freestanding wall is formed by parallel rows of facing block units interengaged by anchors having head ends at each end engaging angularly disposed bore openings in the facing offset units and supported so that the head ends extend into successive stacked staggered units. A column is formed by alternate courses of corner units having angularly disposed bores and side block units interconnected at each course level by anchors having head ends at each end and engaging side units across each of the corners and supported so that the head ends extend into successive rows of corner and side units. Various arrangements of combinations of the wall types with corners and columns is possible due to the arrangement of bores in the block and corner units and the configuration of the two anchor types.

22 Claims, 5 Drawing Sheets

FIG. 7
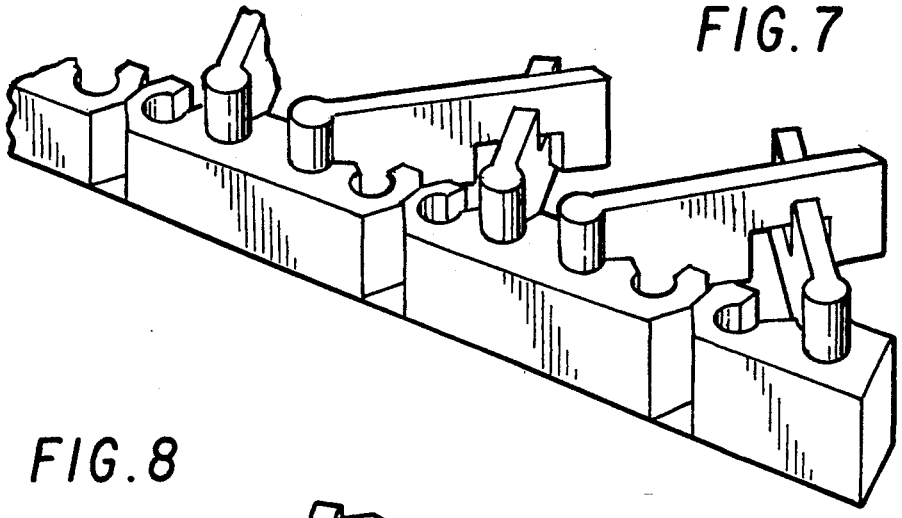
FIG. 8
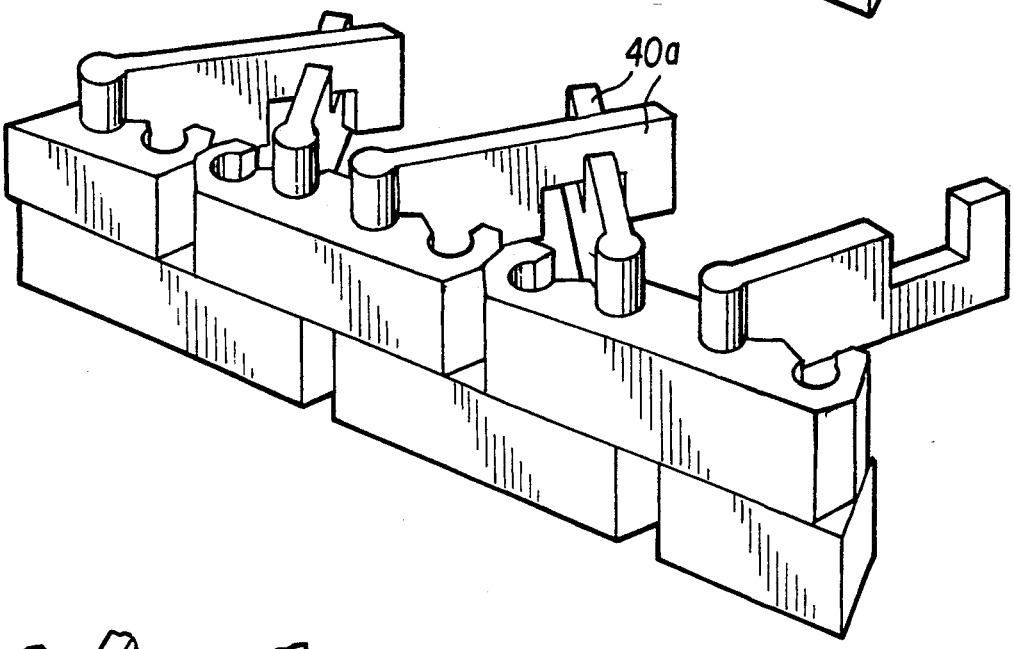
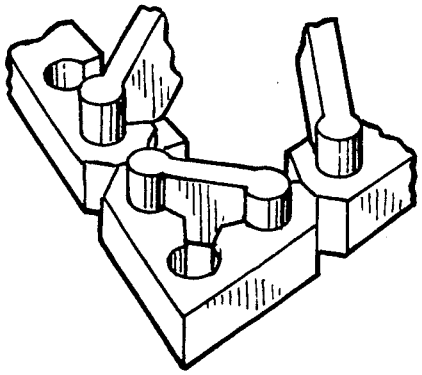
FIG. 11
FIG. 12
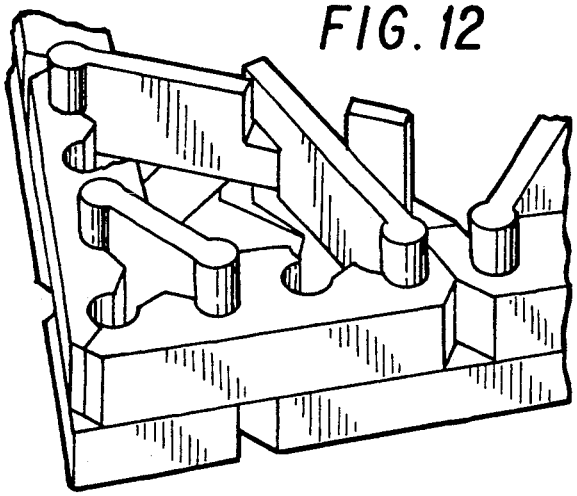

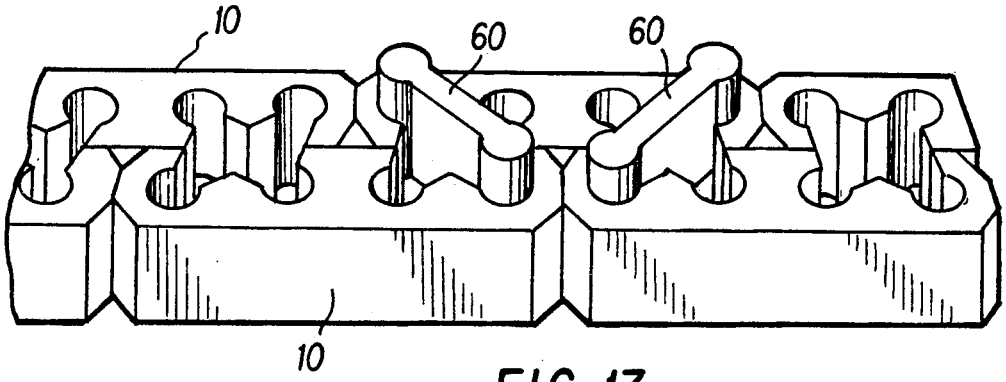
FIG. 13
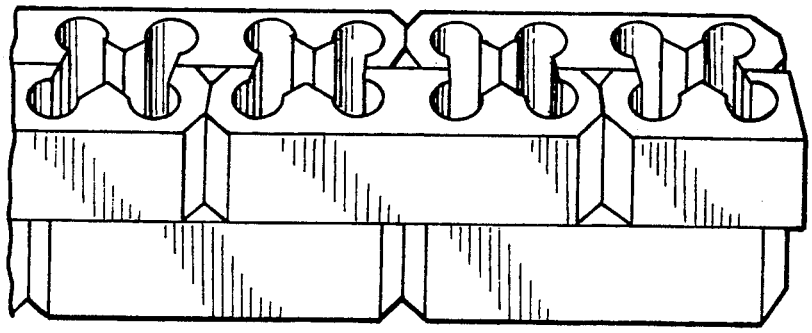
FIG. 14
FIG. 15
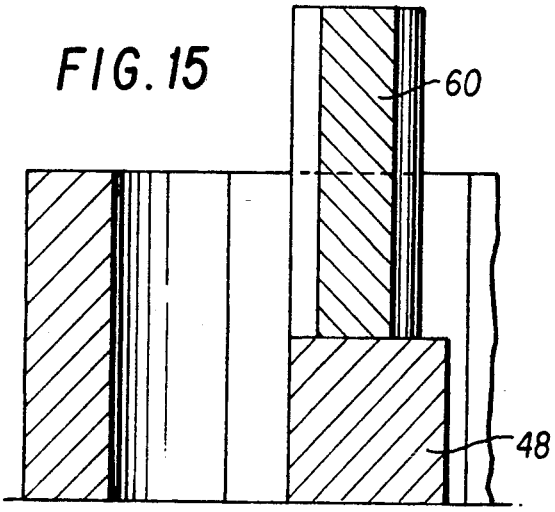
FIG. 16
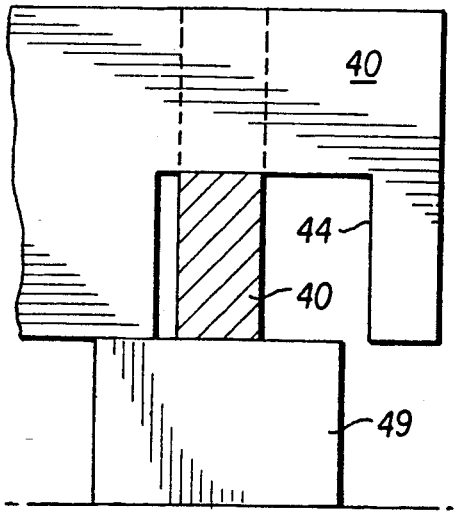

MODULAR WALL SYSTEM

BACKGROUND OF THE INVENTION

1. Field of the Invention

This invention relates to wall structures and more particularly to retaining walls, freestanding or privacy walls and columns formed of modular cast units.

2. Description of the Related Art

Retaining walls have been anchored in various ways including panels or masonry walls attached to tie-rods, bars, geogrid cloth, and blocks with rear extensions. These have generally required connecting the panel or block to the anchoring member and extending it back into the earth or connecting it to another structure. Examples of such walls are disclosed in the U.S. Pat. No. 5,033,912, to Vidal, U.S. Pat. No. 5,066,169, Gavin et al., and U.S. Pat. No. 4,058,944, Rieger.

The U.S. Pat. No. 4,884,378, to Scheiwiller, discloses a wall of blocks having dovetail joints engaged by rearwardly extending securing elements.

Freestanding walls of modular units are commonly constructed of blocks having an outer face and an inner engaging portion for interengagement with a similar engaging portion of a facing block. Examples are disclosed in the U.S. Pat. No. 1,794,060, to Brozek, U.S. Pat. No. 3,557,505, Kaul, U.S. Pat. No. 4,633,630, Kindylides, and U.S. Pat. No. 4,704,832, Vassiliadis.

Other privacy walls include facing units connected by ties between the two sidewalls such as in the U.S. Pat. No. 1,507,831 to Hatch, and U.S. Pat. No. 2,144,630, Kotrbaty.

These types are also disclosed in the U.S. Pat. No. 707,444, to Moses, U.S. Pat. No. 867,954, Davis, and U.S. Pat. No. 2,144,774, Brozek.

Still another type employs modular units connected by medal clips or ties as in the U.S. Pat. No. 1,962,514, to McWilliam.

SUMMARY OF THE INVENTION

It is an object of the invention to provide a mortarless, modular, masonry wall system adapted for retaining walls, freestanding or privacy walls and columns, and combinations thereof.

A further object is to provide a wall system adapted for construction by persons unskilled in conventional block laying and which permits rapid assembly of the various types of walls and columns.

A further object is to provide a wall system in which mortarless interlocking of the modular units is provided by preformed masonry ties, without the need for auxiliary pins, clips or other connecting or strengthening elements.

A still further object is to provide a wall system in which the modular units are interlocked by preformed masonry ties, both laterally and vertically.

A further object is to provide a wall system in which the modular units and the preformed masonry ties are adapted to provide a right angle corner with horizontal and vertical interlocking.

A still further object is to provide a wall system in which a column may be easily constructed and the modular units interlocked by preformed masonry ties.

The foregoing objects are accomplished by the provision of masonry units having front outer faces and spaced vertical bores with reduced rear lateral access openings having alternately converging and diverging axes, and construction material anchors having heads for reception in the bores and having engaging configurations rearwardly of the heads.

In a variation, an alternate form of anchor has a head at each end for connecting offset facing courses forming a privacy wall and for connecting units at a corner.

BRIEF DESCRIPTION OF THE DRAWINGS

FIG. 7 is a perspective of a portion of a first course of a retaining wall in accordance with the present invention.

FIG. 8 is a perspective of the course of FIG. 7 with a second course laid thereon.

FIG. 11 is a fragmentary perspective of an alternate first course, as in FIG. 9, tied into a corner.

FIG. 12 is a fragmentary perspective of an assembly of a first course, as in FIG. 11, with a second course overlying it.

FIG. 13 is a perspective of a portion of a first course of a freestanding wall in accordance with the invention.

FIG. 14 is a perspective of the wall in accordance with the invention.

FIGS. 15 and 16 are sections taken in the lines 15—15 and 16—16 of FIG. 9.

DESCRIPTION OF THE PREFERRED EMBODIMENT

Figure 1:
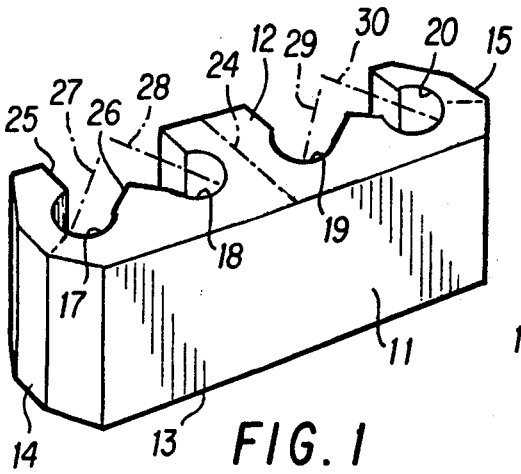
FIG. 1 is a perspective showing the face of a block number in accordance with the present invention.
Figure 2:
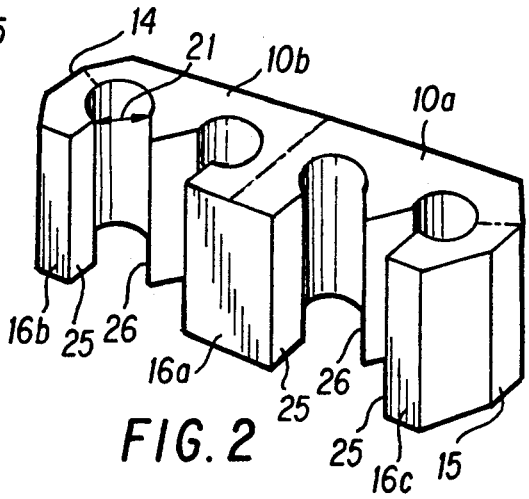
FIG. 2 is a perspective taken from the back side.

A basic masonry unit 10 in accordance with the present invention has an outer face 11, an upper bearing surface 12, a lower bearing surface 13, end walls 14 and 15, a rear wall 16*a*, 16*b* and 16*c* and a series of bores 17, 18, 19, and 20. The bores 17 and 20 are disposed outwardly, as end bores, the intermediate bores 18 and 19, inwardly.

The bores extend vertically through the unit and have a rear access opening 21.

The blocks also have a central splitting groove 24 by means of which a block may be divided into portions 10*a* and 10*b*. While dimensions may vary, a suggested block is 24" long, 8" high, 6" wide and with 3¼" access openings.

The access openings 21 are bordered by angularly disposed faces 25 and 26 which permit a limited amount of angular movement of an anchoring member when it is disposed in one of the bores, as will be presently described. Each of the bores has a generally angularly disposed axis 27, 28, 29, and 30 extending centrally of the bore and its access opening.

Figure 5:
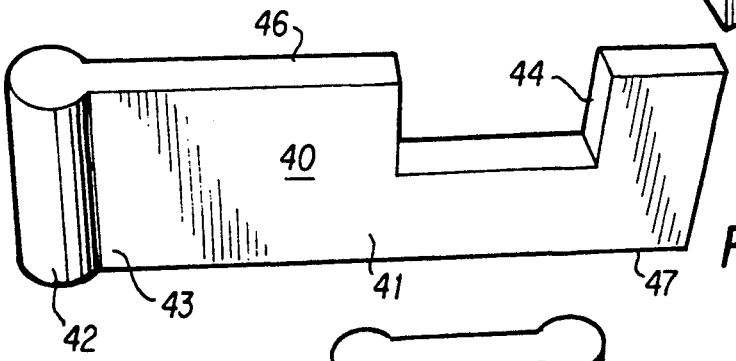
FIG. 5 is a perspective of an anchoring number.
Figure 6:
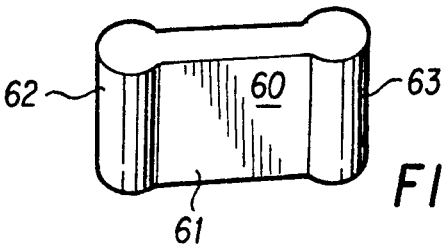
FIG. 6 is a perspective of a special or short anchor.

An anchoring member or tie 40 as indicated in FIG. 5, is provided for use with the block units. The anchoring member has a body or tail portion 41, a substantially cylindrical head portion 42 connected to the tail portion by a neck 43 which may be merely an extension of the body portion 41, the rearward portion of the body portion having a section or notch 44 for engagement with a similar notch of an adjacent anchoring member when positioned in the wall assembly. The anchoring member also has an upper surface 46 and a lower surface 47. The anchoring member may be 24" long with a 3⅛" diameter head, and a 6"×4" notch, for example.

Both the block unit and the anchoring member may be formed of poured concrete or any desired construction material. It is contemplated that the anchor will preferably be formed of high strength concrete.

Figure 9:
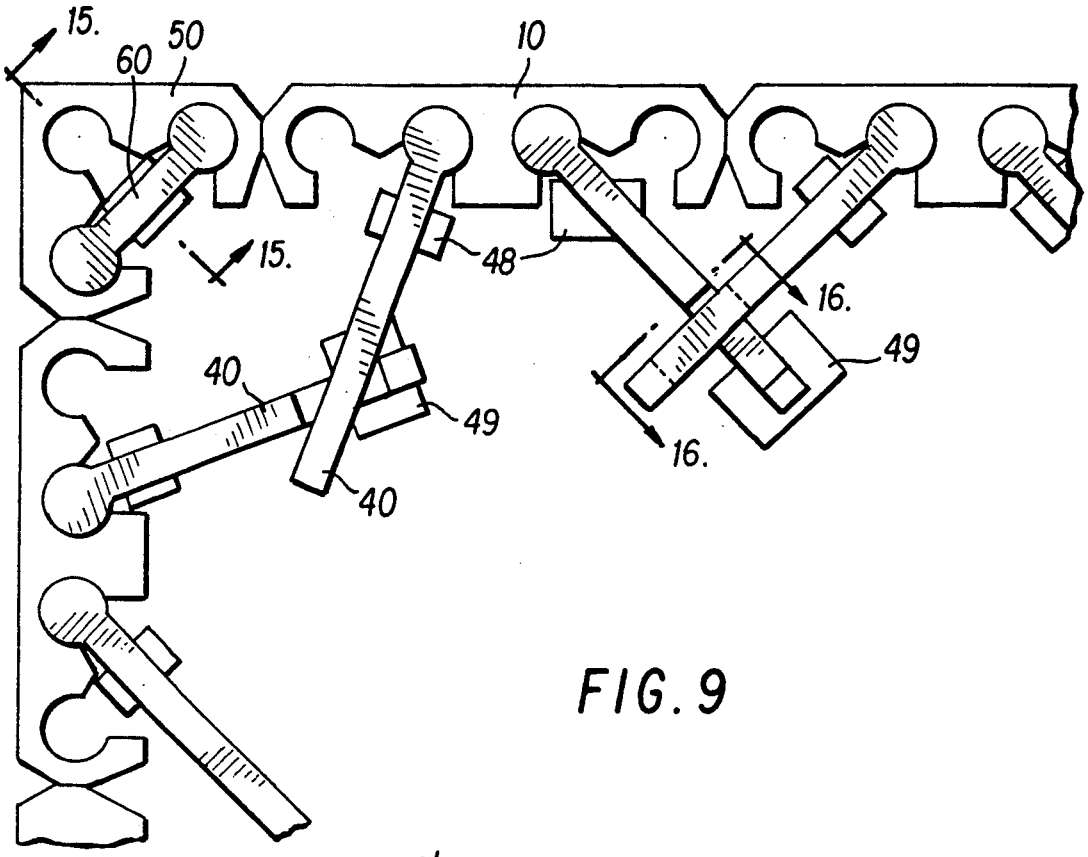
FIG. 9 is a plan view of a first course as in FIG. 7, tied into a corner.

In laying a retaining wall in accordance with the present invention, a first course of a plurality of block members or units 10 are first laid end-to-end on a previously prepared horizontal surface or footing. A series of interlocking anchoring members 40 are then laid in place as indicated in FIGS. 7 and 9, with the ties extending from an inner bore of one block member and in diverging fashion outwardly to interengage, by means of the slot 44 in each, the tie of the next adjacent block member. These are continued along the course to form a series of interengaged X-shaped tie units as indicated.

The lower surface of each tie unit is elevated approximately 4" above the grade by bricks 48, 49 or other element or material in order to provide interlocking for the next course of block members. Thus, when the first course is completed, the block members will be in a line and the tie units will project upwardly above the upper face of the block units approximately one-half the height of a block number.

A second course of block units is then laid on top of the first course of block units, with the joints overlapping those of the first course. In so doing, the bores of the second course of block members are aligned with those of the lower course of block members and the heads of the anchoring members from the inner bores of the lower course engage the bores of the second course which are at the ends of the block units. Thus, the first and second courses are kept aligned due to the projection of the heads of the anchor units through the bores of both courses.

Figure 4:
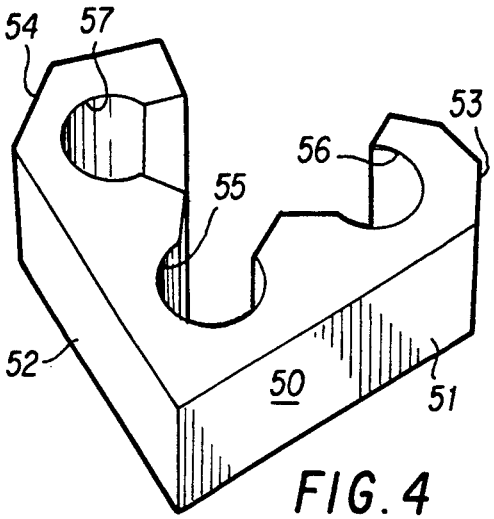
FIG. 4 is a perspective of a corner block unit.
Figure 10:
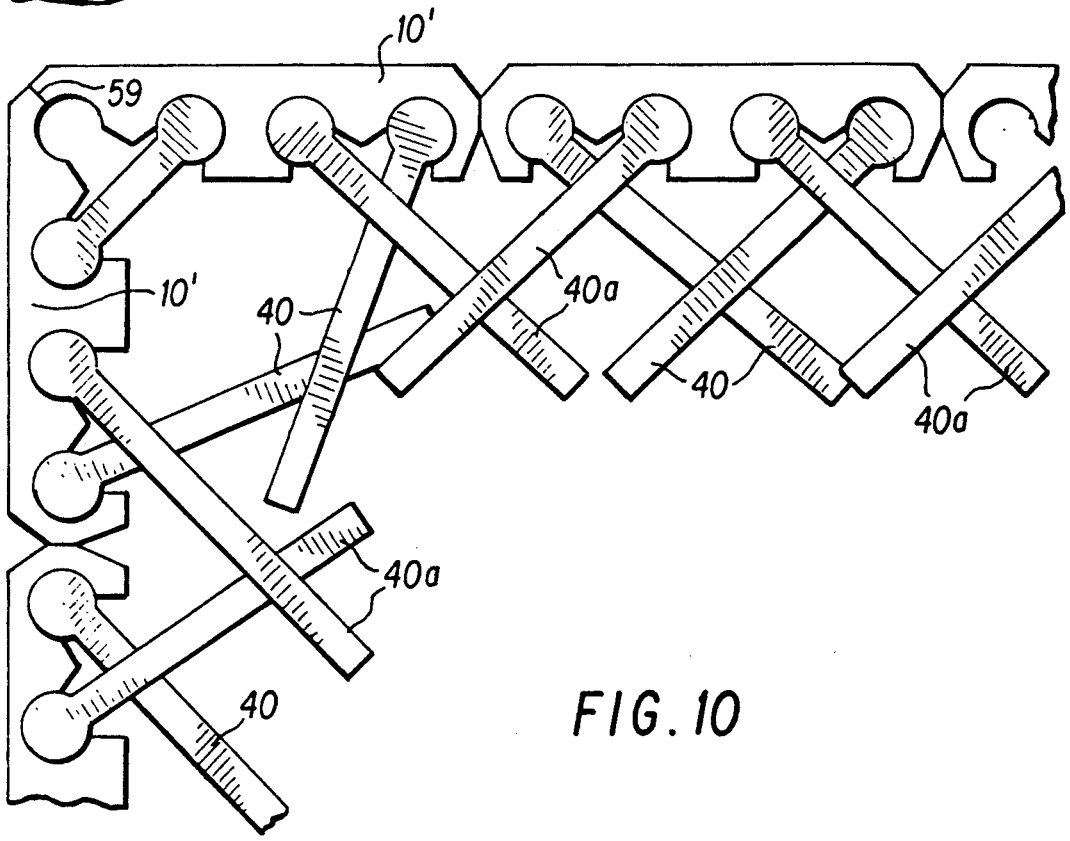
FIG. 10 is a plan view of an assembly of a first course, as in FIG. 9, with a second course overlying it.

If it is desired to extend the height of the wall, then a second layer of anchoring members **40*a* is positioned, again from the inner bores of the second course and diverging outwardly, to form a series of X's along the second course, as indicated in FIGS. 8 and 10, it being understood that the anchors 40*a* of the second course will rest on the anchors 40** of the first course immediately below. Thus, the courses are interlocked both vertically and horizontally due to the anchoring assembly. In order to even the ends of rows of blocks, the alternate courses of the end blocks may be split, in accordance with common practice.

Where it is desired to form a right angle corner for such a wall, a special corner unit 50, see FIG. 4, may be employed having 90° side faces 51, 52, end walls 53, 54, a central corner bore 55, and outer bores 56, 57 which are in spaced relation along the block from the corner bore 55. The corner unit may be 8" high and 12" wide.

In order to interlock and stabilize a corner, as shown in FIGS. 9 and 10, a corner block member 50 is placed at the spaced apart intersection of a pair of end units 10 which have interengaging anchors 40 extending rearwardly from the inner bores of the block units 10. A special anchor 60 joins its bores 56 and 57.

The special corner anchor 60 has a central portion 61 and heads 62, 63, at its ends, the anchor being of a length to bridge the gap between the outer bores 56 and 57. The anchor maybe 8" high, and have 3⅛" diameter heads approximately, 10" apart.

Figure 3:
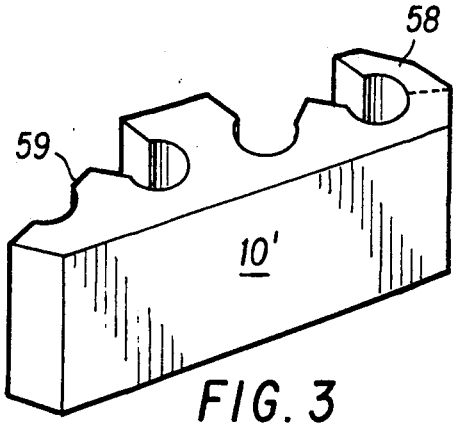
FIG. 3 is a perspective of a block number with an end portion chamfered.

The next course is laid using four bore block members in which the end block members 10" have end portions 58 removed to form a bevelled or chamfered angle face 59 as in FIG. 3. For a square corner the angle is 45°. The regular anchors 40 and the special anchors 60 are continued up for each succeeding course as indicated, thereby interlocking and interconnecting both horizontally and vertically the units at the corner as well as to the remainder of the wall.

An alternate construction for forming a corner is illustrated in FIGS. 11 and 12, in which the anchors 40 are connected to the outer bores of the block members.

After the wall has been built to the desired height, it may be topped off, for example, by a plain cap connected by an epoxy adhesive, or the bores of the uppermost course may simply be filled with suitable material. Then, in order to anchor the wall, the space behind it may be backfilled with gravel, earth, concrete, or other suitable material.

The block units may be interlocked to form a freestanding or privacy wall as indicated in FIGS. 13–16, using the short special anchors 60 that were previously described for use in the corners. In the freestanding wall, courses of block members 10 are laid facing each other and in staggered relationship with the anchors or spacers 60 extending between the opposed units of each course. Such anchors may be engaged with either the out bores, as shown or with inner bores, and are preferably angularly disposed from one course to the next. Those of the first course are elevated, as previously described in order to extend vertically above the upper surface of a particular course. In this way, the courses are interlocked both vertically and horizontally.

Figure 17:
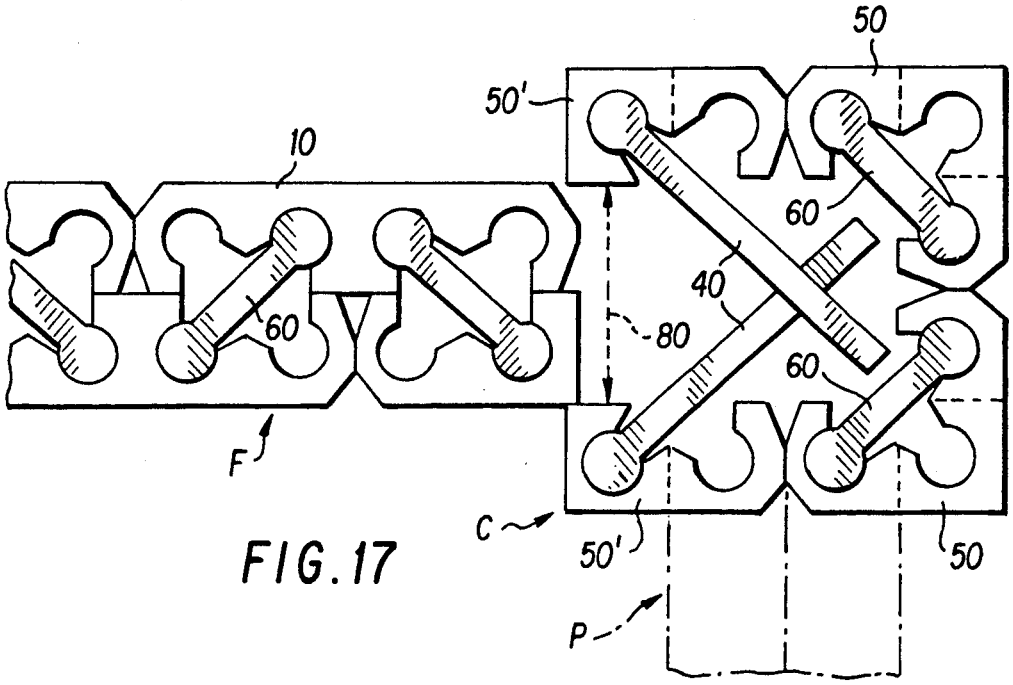
FIG. 17 is a plan view illustrating a first course of a freestanding wall connected to a first course of a modified column.
Figure 18:
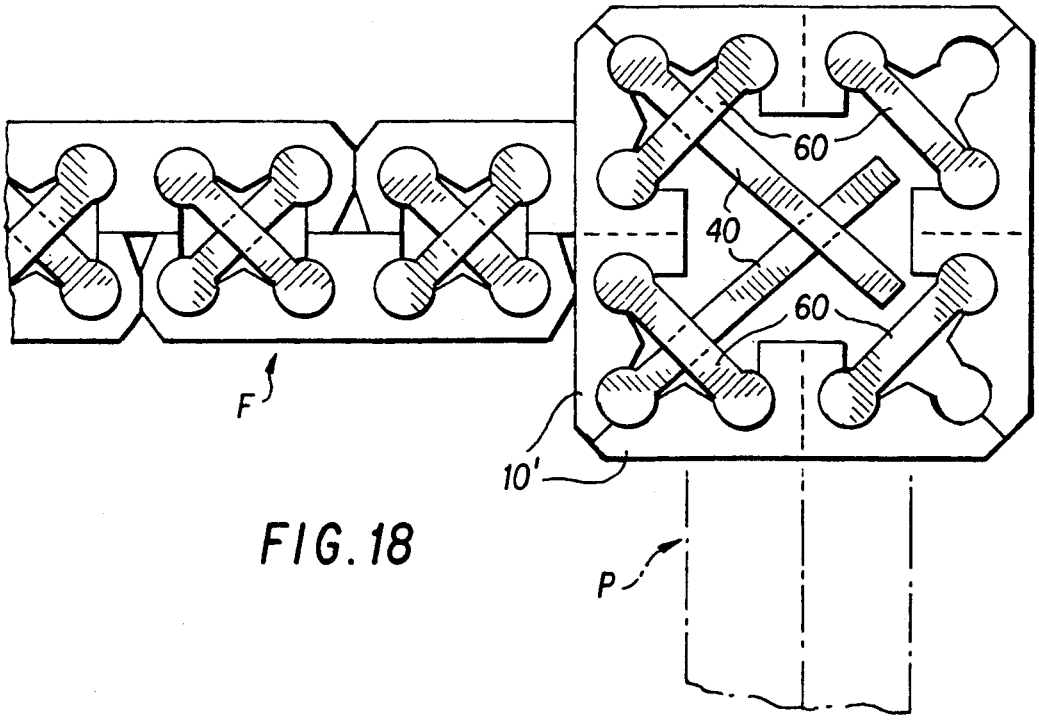
FIG. 18 is a plan view illustrating the second courses of the wall and column of FIG. 17.

A block column may be formed as generally indicated in FIGS. 17 and 18, employing the short anchors or spacers 60. The column of FIGS. 17 and 18 is modified, however, to show a column connected to a freestanding wall, as will be described. In forming the column, the first course may be formed by arranging four corner units 50 to form a column and with the special anchors 60 interengaging the corner units across the four corners. The second course is then laid with four block members 10' with mitered corners, the block members being interconnected by another set of anchors 60 and also being interconnected vertically with the lower course by the preceding set of anchors.

In preparation for laying a column, if laid on concrete, holes should be drilled to align with the splitter holes of the first course and rebar rods driven into the drilled holes and inserted into the splitter holes. Anchors may then be positioned, as previously described. The first course should preferably be filled with concrete and succeeding courses with gravel. Over asphalt, the rebar rods may be driven into it. When placed over compacted soil, at least two holes approximately two feet deep may be dug with post hole diggers. Rebar rods are then placed in each hole to extend 8" above the hole and into the splitter holes of two oppositely disposed blocks. The dug holes and the first course of block is then filled with concrete.

In order to tie a freestanding or privacy wall F to a column C, an arrangement as shown in FIGS. 17 and 18 may be used. In this the first course of the column is formed with two corner units 50 and with partial corner units 50', with ends removed. The corner units are tied with special anchors 60 and the partial units are tied by regular anchors 10, having a space 80 between the broken ends of the facing units. An end of the privacy wall is then laid into the space so in order to interlock the wall and the column and to further stabilize the wall. In the next course, FIG. 18, the column is built with four blocks with mitered corners and the second course of the freestanding wall abuts the side block of the column. The third course is a repeat of the first course.

If desired, the column may be tied to a freestanding wall P at right angles to wall F by removing another end from corner unit 50', and an end from the side corner unit 50, permitting the laying of an end of wall P in alternate courses of the column. The partial entry of the walls F and P into the column at alternate ends, and the stablizing of the block member within the column, itself, by the anchors, provides a strong stable structure.

It will be understood that the present system can be used for various wall applications including where space is limited and by persons having only a limited knowledge of block laying. The system provides both vertical and horizontal interlocking with the assurance of high strength concrete instead of relying upon clips or pins of various materials. The anchor system is incorporated into the block and anchor members thereby reducing the initial material cost and eliminating the need for a helper when aligning the units. Since the block units and the anchors are the same whether viewed from the top or the bottom, the assembly of the same is particularly simplified and may be varied to suit individual preferences. A user also has the option of constructing a retaining wall, a privacy wall, or a column, and combinations thereof, using the same basic units, thereby further simplifying construction.

I claim:

1. A masonry construction block assembly unit comprising a block member having an outer face, upper and lower substantially parallel planar bearing surfaces, end walls and a rear wall, said block member having a plurality of spaced bores extending vertically therethrough, each of said bores having an access opening through said rear wall, the diameter of each bore exceeding the width of its access opening, each said bore having a lateral axis substantially parallel to the plane of the bearing surfaces of the block member and extending centrally of the bore and its access opening, said block member having first and second bores and access openings at its remote ends whose respective lateral axes converge generally toward each other, said block member having third and fourth intermediate bores in spaced relation and adjacent to said first and second bores, respectively, the lateral axes of said third and fourth bores diverging generally away from the center of the block member, and said first second, third and fourth bores including portions lying substantially in a common vertical plane.

2. A block assembly of a plurality of block members in accordance with claim 1, and a plurality of anchoring means, each said anchoring means comprising an elongated tie having a head adapted to be received in a bore and to engage the same whereby the tie is retained against lateral withdrawal, and a neck adapted to be received in an access opening, said tie having an engaging means remote from its head, whereby the heads of a pair of anchoring means may engage the third and fourth bores in an adjacent end-to-end pair of block members and be interengaged remote from their heads.

3. The block assembly of claim 2, in which the tie head is of a size to extend substantially entirely through the block member between its upper and lower bearing surfaces.

4. The block assembly of claim 2, in which the engaging means is a slot in each tie.

5. The block assembly of claim 2, in which the anchoring means is of cast concrete.

6. A block assembly of a plurality of block members in accordance with claim 1 and a plurality of anchoring means, each said anchoring means comprising an elongated tie having upper and lower sides and having a head adapted to be received in a bore and to engage the same whereby the tie is retained against lateral withdrawal, and a neck adapted to be received in an access opening, said tie having an engaging means remote from its head, whereby a pair of anchoring means may be interengaged remote from their heads, in which a first course of block members is laid end-to-end and a plurality of anchoring means is positioned to interconnect adjacent block members, in which the anchoring means are supported on their lower sides so that they extend substantially above the upper bearing surfaces of the first course of block members, and in which a second course of block members is laid on top of said first course of block members with the end walls of the second course staggered from the end walls of the first course, and with the bores of the block means of the first and second courses in alignment, the anchoring means from the first course extending into bores in the second course.

7. The block assembly as in claim 6, and a third course of side-by-side members is laid end-to-end on top of said second course and with the end walls of the third course staggered from the end walls of the second course and with the bores of the block members of the first, second and third courses in alignment, and a plurality of anchor means from the second course supported on anchor means in the first course and extending into bores in the third course.

8. A block assembly in accordance with claim 6 in which an end of a first end block member is chamfered to engage a similar end of a second end block member at an angle, and in which a second course of block members is laid on top of said first course of block members with the end walls of said first course staggered from the end walls of said second course, and the bores of the first and second courses are in alignment, and in which a corner block unit is positioned on the second course over the chamfered ends of said first and second end block members, said corner block unit having angularly disposed outer face portions and end walls, a central bore, and an outer bore adjacent to each of its end walls, the outer bores being aligned with an intermediate bore of each of the end first and second block members.

9. A block assembly of a plurality of block members in accordance with claim 1, said block members arranged in parallel lines with joints therebetween, and with their rear walls contiguous to and facing each other and with their joints offset from each other in the facing lines, and a plurality of longitudinal ties connecting the block members across said facing lines, each tie having a head at each of its ends received in a bore of a block member and extending vertically above its upper bearing surface, a central portion adapted to pass through the access opening of a block member.

10. The block assembly of claim 9, in which the tie head is of a size to extend substantially entirely through the block member between its upper and lower bearing surfaces.

11. The block assembly of claim 9, in which the tie is of cast concrete.

12. A block assembly of a plurality of block members forming a column, comprising a course of block members in accordance with claim 1 having four block members arranged in a rectangle and with the end walls of the block members chamfered to permit arrangement in perpendicular relationship to the next adjacent block members, a tie extending between the intermediate bores of adjacent block members, an alternate course of block units overlying the course of block members, each block unit having perpendicular outer face portions and end walls, a central bore, and an outer bore adjacent to each of its end walls, and in which the lateral axes of said first and second bores and their access openings substantially coincide, the outer bores being aligned with an intermediate bore of the block members of each course in accordance with claim 1, a tie extending across the bores of each corner block unit, the ties in each course extending vertically above each course and into the bores of the next succeeding course in order to interlock the block members and corner block units vertically and horizontally.

13. The block assembly of claim 12 interconnected to a freestanding wall assembly, said freestanding wall assembly comprising a plurality of block members arranged in parallel lines with their rear walls contiguous to and facing each other and with joints therebetween, and with their joints offset from each other in the facing lines, and a plurality of longitudinal ties connecting the block members across said facing lines, each tie having a head at each of its ends received in a base of a block member and a central position passing through the access opening of a block member, said ties extending between spaced bores of said block members, a second course of said wall assembly arranged with the block members staggered from said first course, seriatim, the heads extending between courses, alternate courses of said column having an end portion of a first alternate end-to-end pair of corner block units removed to provide an opening approximately the combined width of the freestanding wall assembly, an elongated tie engaged with the central bore of said first corner block units and having a head received in said bore whereby the tie is retained against lateral withdrawal, and a neck received in an access opening, said tie having an engaging means remote from its head, said pair of anchoring means interengaged remote from their heads, and the end walls of a first course positioned within said opening, an alternate course of said column which is formed of four block members arranged in a rectangle having their outer faces abutting an end wall of said freestanding wall assembly, seriatim.

14. A masonry construction block assembly unit comprising a block member having perpendicularly disposed outer face portions, upper and lower substantially parallel planar bearing surfaces, end walls and a rear wall, said block member having a plurality of spaced bores extending vertically therethrough, each of said bores having an access opening through said rear wall, the diameter of each bore exceeding the width of its access opening, each said bore having a lateral axis substantially parallel to the planes of the bearing surfaces of the block member and extending centrally of the bore and its access opening, said block member having opposed first and second bores whose lateral axes substantially coincide, and a third bore intermediate said first and second bores and substantially equally spaced therefrom.

15. A method of erecting a wall comprising providing block members in accordance with claim 1, providing a plurality of anchoring means, each said anchoring means comprising an elongated tie having a head adapted to be received in a bore and to engage the same whereby the tie is retained against lateral withdrawal, and a neck adapted to be received in an access opening, said tie having an engaging means remote from its head, whereby a pair of anchoring means may be interengaged remote from their heads, providing a level surface, laying a first course of block members end-to-end on said surface, laying an elongated tie from said third and fourth bores of each block member and diverging outwardly of said block member, whereby the ties from adjacent block members are interengaged, providing support means beneath said ties whereby their heads extend vertically substantially above the upper bearing surfaces of said block members, laying a second course of block members on said first course with the joints between block members and the second course staggered intermediate the joints in the first course and with the first and second bores of the second course aligned with the fourth and third bores, respectively, of the first course, whereby the ties from said third and fourth bores of the first course extend upwardly into the first and second bores of said second course.

16. The method of claim 15, and laying an elongated tie from said third and fourth bores of said second course, said ties supported by overlapping said ties in said first course so that they extend vertically above the upper bearing surfaces of said second course of block members, and laying a third course of block members on said second course in staggered relationship whereby the ties of said second course extend substantially upwardly into the bores of said third course.

17. The method of claim 15, and laying a corner at an end of said wall, comprising providing an end block member at an end of said wall, said end block member having its outer end chamfered, laying another end block member at right angles to said end block member and having an outer end chamfered, and laying an elongated tie from an inside bore of said end block members across a corner and into engagement with each other, thereby tying the end block members of said corner together.

18. The method of claim 17, and providing a corner block unit having perpendicularly disposed face portions and end walls, a central bore adjacent to its apex, and an outer bore adjacent to each of its end walls, and laying said corner block unit over the junction of said end block members, and laying a tie across the outer bores of said corner block unit.

19. A method of erecting a freestanding wall comprising providing block members in accordance with claim 1, laying a first course of block members end-to-end on a base, laying another first course of block members arranged in parallel with said first course of block members and with their rear faces contiguous to and facing each other and with their joints offset from each other in the facing courses, and providing a plurality of longitudinal ties, each tie having a head at each of its ends adapted to be received in a bore of a block member and a central portion adapted to pass through the access opening of a block member, laying said ties diagonally in the offset bores of said facing block members, and supporting said ties so that they extend vertically above the upper faces of said block members.

20. The method of claim 19, and laying a second course of parallel lines of block members on said first course of parallel lines of block members with the joints between said block members staggered and with the bores of said block members in alignment with those in the preceding course whereby the ties extend upwardly from the lower course into the block members of the second course.

21. A method of erecting a column of block members comprising laying a course of block members in accordance with claim 1, in which the end walls of the block members are chamfered and arranging four of said block members to form a square column, interlocking the perpendicularly disposed block members together by ties extending between the adjacent intermediate bores thereof, laying a second course of corner block units on the first course of block members, said second course of corner block units having perpendicularly disposed outer face portions and end walls, a central bore, and an outer bore adjacent to each of its end walls, the outer face portions being substantially co-planar with the outer faces of said block members, and the end walls of said corner block units being staggered from the end walls of said block members, in which the ties from the first course of block members extend vertically into the outer bores of said corner units, whereby the block members are interlocked together laterally and vertically.

22. A method of interconnecting a column assembly to a freestanding wall assembly, comprising providing a column assembly in accordance with claim 12, removing an end portion of a first alternate end-to-end pair of corner block units to provide an opening approximately the width of said freestanding wall assembly, positioning the end walls of a first course of said wall assembly within said opening, placing the head of an elongated tie within the central bore of each of said first alternate end-to-end pair of corner block units, said tie having a neck received in an access opening of said central bore and having an engaging means remote from its head, the engaging means of the ties being interengaged, abutting the end walls of a second course of said wall assembly against the outer faces of the next course of corner block units, seriatim.

* * * * *